United States Patent [19]

Koichi

[11] Patent Number: 4,734,737

[45] Date of Patent: Mar. 29, 1988

[54] CONTROL OF TONER CONCENTRATION IN A DEVELOPER

[75] Inventor: Yasushi Koichi, Yamato, Japan

[73] Assignee: Ricoh Company, Ltd., Tokyo, Japan

[21] Appl. No.: 743,922

[22] Filed: Jun. 12, 1985

[30] Foreign Application Priority Data

Jun. 18, 1984 [JP] Japan ..... 59-124872

[51] Int. Cl.[4] ..... G03G 15/08

[52] U.S. Cl. ..... 355/14D; 118/689; 118/690; 222/DIG. 1; 355/3 DD

[58] Field of Search ..... 355/3 R, 3 DD, 14 D; 222/DIG. 1; 118/688, 689, 690, 691

[56] References Cited

U.S. PATENT DOCUMENTS

| | | | |
|---|---|---|---|
| 4,032,227 | 6/1977 | Hubbard et al. | 355/14 D |
| 4,226,525 | 10/1980 | Sakamoto et al. | 355/14 D |
| 4,364,659 | 12/1982 | Noda | 355/14 D |
| 4,462,680 | 7/1984 | Ikeda | 355/14 D |

*Primary Examiner*—Fred L. Braun

*Attorney, Agent, or Firm*—Oblon, Fisher, Spivak, McClelland & Maier

[57] ABSTRACT

A toner concentration control method and system for controlling the toner concentration of a developer which includes toner and carrier for use in electrophotography. A controller, typically including a central processing unit or CPU, first determines a degree of deviation of the current toner concentration from a predetermined reference level and then replenishes the toner to the developer at an optimal replenishing condition which is varyingly set in accordance with the detected degree of deviation. In the preferred embodiment, the flow rate of toner to be supplied and time period of replenishing operation are varyingly set. Besides, the frequency of toner concentration detecting operation is also varyingly set so as to alleviate the load of the CPU.

11 Claims, 2 Drawing Figures

CONTROL OF TONER CONCENTRATION IN A DEVELOPER

BACKGROUND OF THE INVENTION

1. Field of the Invention

The present invention relates to a method and system for controlling the toner concentration in a developer for developing an electrostatic latent image, and in particular, to a toner concentration control method and system for use in electrophotographic copying machines.

2. Description of the Prior Art

In an electrophotographic copying machine employing the so-called two component developer comprised of toner and carrier beads, it has been known to control the concentration of toner in the developer. One approach to detect the toner concentration of developer relies on a variation in inductance depending on the toner concentration, and another approach is to detect the optical density of a reference pattern formed on a photosensitive drum. Conventionally, the toner concentration was measured by either of these approaches and the thus measured toner concentration was compared with a predetermined reference level at a predetermined interval, and when the measured toner concentration was found to be lower than the reference level, a toner replenishing unit was activated to supply a predetermined amount of toner to the developer.

In this manner, in accordance with the prior art technique, a predetermined amount of toner was replenished every time when the measured toner concentration was found to be lower than the reference level, so that the developer could be prevented from becoming toner scarce condition. However, in accordance with such prior art approach, since the developer was examined at regular intervals as to whether or not its toner concentration was lower than the reference level irrespective of the degree of toner concentration, data processing was carried out unnecessarily, which was a burden to a control unit. Besides, since a predetermined amount of toner was replenished irrespective of the degree of deviation of the detected toner concentration from the reference level, it was often observed that the toner concentration became excessive or too scarce, which thus caused instability in the performance of development.

SUMMARY OF THE INVENTION

In accordance with the principle of the present invention, there is provided a toner concentration control system which comprises a central processing unit (CPU) in which a plurality of control tables are stored. Upon receipt of a signal indicating the size of copy sheet to be used, one of the plurality of tables is selected for use. At the same time, the current level of toner concentration of developer is detected and its detected concentration signal is supplied to the CPU. Thus, the CPU determines the degree of deviation of toner concentration from a predetermined reference level and the CPU causes a toner replenishing unit to operate varyingly in accordance with the degree of deviation thus determined. Based on the detected level of toner concentration, the frequency of concentration detection is varyingly determined. In general, the frequency of detection increases as the deviation from the reference level increases. Moreover, the larger the deviation of detected toner concentration from the reference level, the more the amount of toner to be replenished. In this manner, in accordance with the present invention, the toner concentration of developer can be maintained at constant at all times, so that the quality of developed image can always be maintained high.

It is therefore a primary object of the present invention to obviate the disadvantages of the prior art as described above and to provide an improved method and system for controlling the toner concentration of developer.

Another object of the present invention is to provide a toner concentration control method and system capable of varyingly setting the concentration detecting period depending on the size of copy sheet to be used.

A further object of the present invention is to provide a toner concentration control method and system capable of varyingly setting an amount of toner to be replenished.

A still further object of the present invention is to provide an improved toner concentration control method and system accurate and reliable in operation.

Other objects, advantages and novel features of the present invention will become apparent from the following detailed description of the invention when considered in conjunction with the accompanying drawings.

DESCRIPTION OF THE PREFERRED EMBODIMENTS

Figure 1:
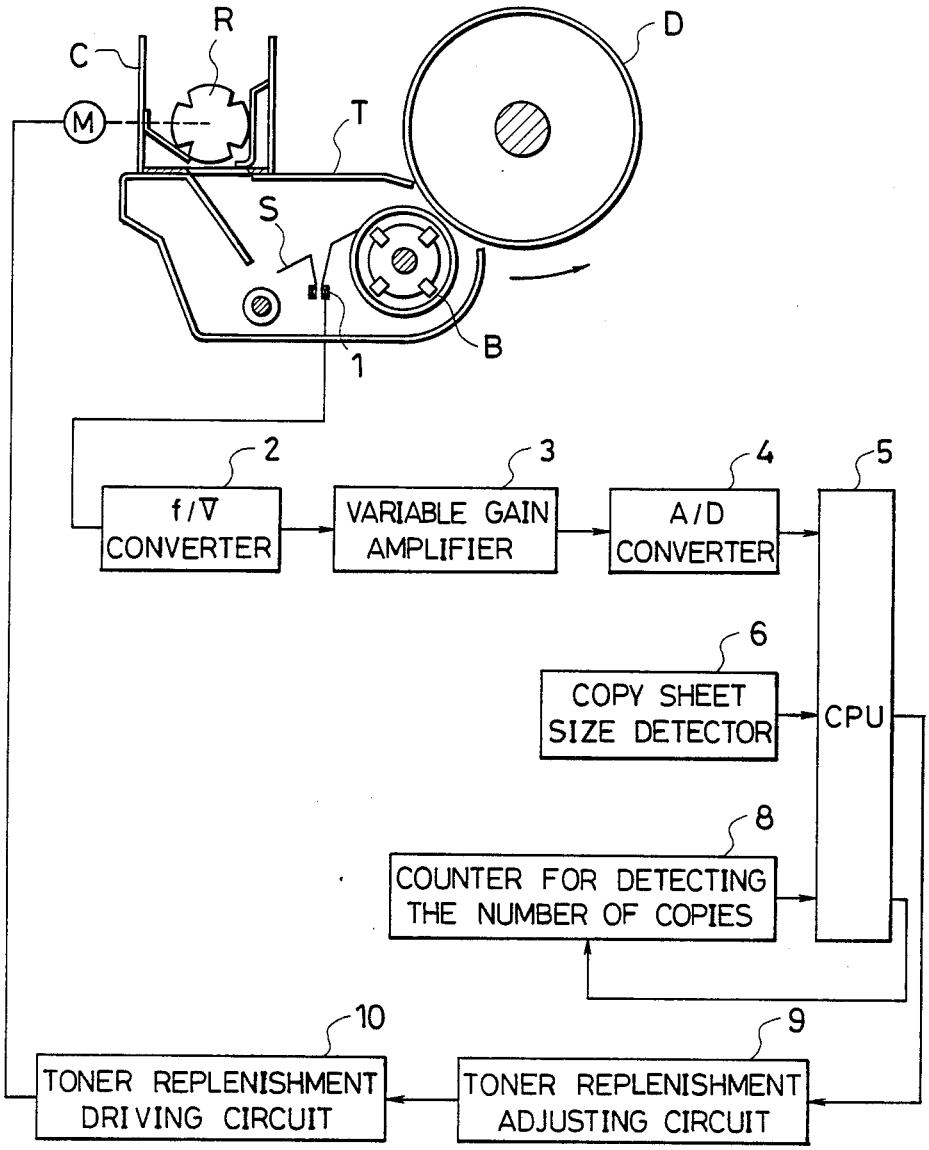
FIG. 1 is a schematic illustration showing the overall structure of a toner concentration controlling system constructed in accordance with one embodiment of the present invention.

Referring now to FIG. 1, there is schematically shown a toner concentration control system constructed in accordance with one embodiment of the present invention. As shown, there is provided a developer tank T for containing therein a quantity of developer as located adjacent to a photosensitive drum D which is driven to rotate in a direction indicated by the arrow at constant speed. As well known in the art, around the drum D is disposed various components, such as a corona charger and an image exposing unit, for forming an electrostatic latent image on the outer peripheral surface thereof. These components are normally disposed upstream of the developer tank T with respect to the direction of rotation of the drum D. Typically, additional components, such as an image transfer unit and a cleaning unit, are disposed around the drum D and downstream of the developer tank T with respect to the direction of rotation of the drum D.

Within the tank T and adjacent to the drum D is disposed a developing sleeve B which is rotatably supported and normally driven to rotate, counterclockwise in the illustrated embodiment. Inside of the sleeve B is disposed a magnet roll so as to provide a magnetic field at the outer peripheral surface of the sleeve B so that magnetic brush comprised of a two-component developer including toner and carrier beads is formed on the outer peripheral surface of the sleeve B. As is well known, the magnetic brush is formed such that the toner electrostatically clings to the carrier beads which are magnetically attracted to the outer peripheral surface of the sleeve B. A toner container C is provided at the top of the tank T and a toner replenishing roller R provided with a plurality of longitudinal grooves in its outer peripheral surface is provided at the bottom of the toner container C, so that the toner stored inside of the container C is supplied into the tank T as the roller R is driven to rotate by means of a motor M. As will become clear later, in accordance with the present invention, the motor M drives to rotate the roller R at different speed so that the amount of toner to be replenished per unit time may be set differently.

Also provided in the tank T is a toner concentration detector 1 which is comprised of an inductance element for detecting the toner concentration of the developer in the tank T as derived from the value of detected inductance. The detector 1 is provided as mounted on a separator S which has its one end in sliding contact with the outer peripheral surface of the sleeve B on which the magnetic brush of developer is formed. Thus, the developer attracted to the sleeve B in the form of magnetic brush is brought into contact with the outer peripheral surface of the drum D on which a latent image to be developed is formed as the sleeve B rotates in the counterclockwise direction. And, as the sleeve B further rotates, the developer remaining on the sleeve B is removed from the sleeve B and then slides down along the inclined separator S.

The detector 1, on the other hand, is connected to a frequency-to-voltage converter 2 where a signal from the detector 1 is converted into an analog signal. The f/V converter 2 is connected to a CPU 5 through a variable gain amplifier 3 and an A/D converter 4. When the toner concentration of the developer inside of the tank T is at a predetermined reference level, the variable gain amplifier 3 supplies an output voltage of 2 V. The output voltage from the amplifier 3 is converted into a 4-bit digital signal by the A/D converter 4, whereby a deviation from the reference level or 2 V is converted into the 4-bit digital signal using 0.25 V as one unit. The thus obtained digital singal is then supplied into the CPU 5.

Also connected to the CPU 5 is a copy sheet size detector 6 which detects the size of copy sheets to be used and supplies this information to the CPU 5. Also provided is a counter 8 as connected to the CPU 5 and it counts the number of copies developed by the developer stored in the tank T. The CPU 5 has a memory in which a plurality of predetermined tables for use in toner concentration control operation are stored. It is to be noted that such a memory may be provided external to the CPU 5. Two examples of toner concentration control tables stored in the CPU 5 are shown below.

TABLE I

| Bit 8 4 2 1 | Time Period per copy | Rotational Speed of Motor | Detection Interval |
|---|---|---|---|
| 0 0 0 0 | off | off | 11 |
| 0 0 0 1 | 0.5 sec | 60 rpm | 11 |
| 0 0 1 0 | 0.5 sec | 60 rpm | 11 |
| 0 0 1 1 | 0.5 sec | 60 rpm | 11 |
| 0 1 0 0 | 1.0 sec | 60 rpm | 11 |
| 0 1 0 1 | 1.0 sec | 60 rpm | 8 |
| 0 1 1 0 | 1.0 sec | 60 rpm | 8 |
| 0 1 1 1 | 1.0 sec | 90 rpm | 8 |
| 1 0 0 0 | 1.0 sec | 90 rpm | 5 |
| 1 0 0 1 | 1.5 sec | 90 rpm | 5 |
| 1 0 1 0 | 1.5 sec | 90 rpm | 5 |
| 1 0 1 1 | 1.5 sec | 90 rpm | 5 |
| 1 1 0 0 | 1.5 sec | 90 rpm | 5 |
| 1 1 0 1 | 2.0 sec | 90 rpm | 5 |
| 1 1 1 0 | 2.0 sec | 90 rpm | 2 |

TABLE I-continued

| Bit 8 4 2 1 | Time Period per copy | Rotational Speed of Motor | Detection Interval |
|---|---|---|---|
| 1 1 1 1 | 2.0 sec | 120 rpm | 2 |

TABLE II

| Bit 8 4 2 1 | Time Period per copy | Rotational Speed of Motor | Detection Interval |
|---|---|---|---|
| 0 0 0 0 | off | off | 11 |
| 0 0 0 1 | 0.25 sec | 60 rpm | 11 |
| 0 0 1 0 | 0.25 sec | 60 rpm | 11 |
| 0 0 1 1 | 0.25 sec | 60 rpm | 11 |
| 0 1 0 0 | 0.5 sec | 60 rpm | 11 |
| 0 1 0 1 | 0.5 sec | 60 rpm | 8 |
| 0 1 1 0 | 0.5 sec | 60 rpm | 8 |
| 0 1 1 1 | 0.5 sec | 90 rpm | 8 |
| 1 0 0 0 | 0.5 sec | 90 rpm | 5 |
| 1 0 0 1 | 0.75 sec | 90 rpm | 5 |
| 1 0 1 0 | 0.75 sec | 90 rpm | 5 |
| 1 0 1 1 | 0.75 sec | 90 rpm | 5 |
| 1 1 0 0 | 0.75 sec | 90 rpm | 5 |
| 1 1 0 1 | 1.0 sec | 90 rpm | 5 |
| 1 1 1 0 | 1.0 sec | 90 rpm | 2 |
| 1 1 1 1 | 1.0 sec | 120 rpm | 2 |

One of the toner concentration control tables as shown in Tables I and II above is selected for use depending on the size signal from the size detector 6. As shown in Tables I and II, the time period and the rotational speed of motor M for replenishing toner from the container C to the tank T increases proportionately as the deviation of the detected toner concentration from the reference level increases. On the other hand, the detection interval or the number of copies to be made between the two successive detecting operations decreases and thus the detection frequency increases as the deviation of detected toner concentration from the reference level increases. Put it another way, as the detected level of toner concentration becomes further away from the predetermined reference level, the detection of toner concentration is carried out more often.

The CPU 5 presets a count in the counter 8 depending on the deviation of the detected toner concentration from the reference level, and, thus, the count to be set in the counter 8 corresponds to the number of copies to be made between the two successive concentration detection operations. Every time when the counter 8 counts up to this preset value, the counter 8 is reset, and, at the same time, the counter 8 supplies as its output a sampling signal for causing the CPU 5 to detect the deviation of the current toner concentration from the reference level.

The control system also comprises a toner replenishing amount adjusting circuit 9 as connected to the CPU 5 for adjusting the amount of toner to be supplied in a single replenishing operation. Upon detection of a deviation of the current toner concentration from the reference level, a desired control data including the time period and rotational speed of motor M for replenishing toner from container C to the tank T is selected from the selected table and temporarily set in the toner replenishment adjusting circuit 9. Based on the thus set data, the circuit 9 activates the motor M through a toner replenishment driving circuit 10 so that the motor M drives to rotate the roller R for a selected time period at a selected rotational speed. As a result, a desired amount of toner is supplied to the tank T from the toner container C within a desired time period.

Figure 2:
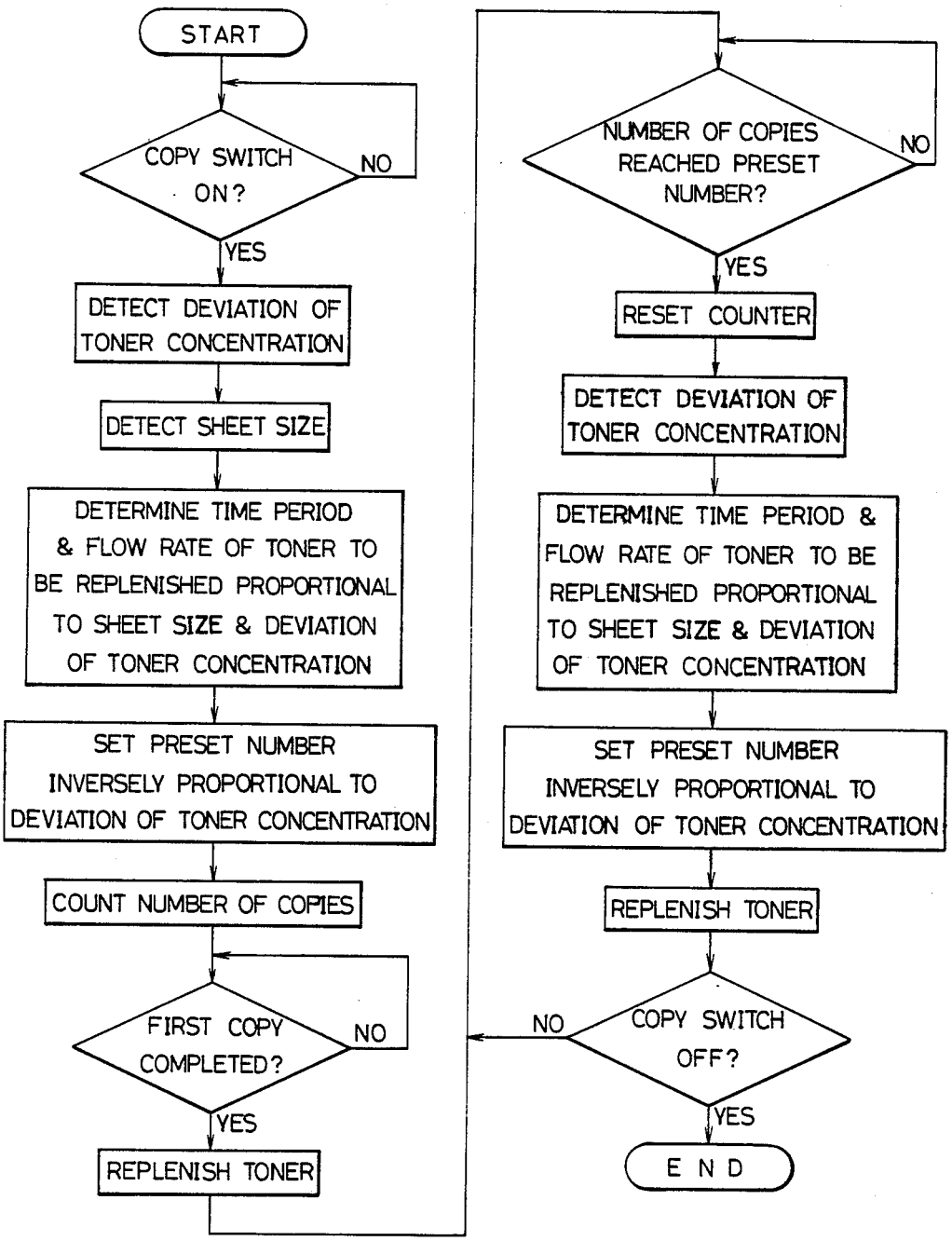
FIG. 2 is a flow chart useful for explaining the operation of the system shown in FIG. 1.

Now, the operation of the toner concentration control system illustrated in FIG. 1 having the structure as described above will be described with reference to a flow chart shown in FIG. 2.

When a copy button is depressed after turning on of a power switch of an electrophotographic copying machine in which the system of FIG. 1 is incorporated, the counter 8 is cleared and the size detector 6 detects the size of copy sheets selected for use. And, at the same time, the developer inside of the developer tank T is passed through the toner concentration detector 1 so that the detector detects the current toner concentration and this information is supplied to the CPU 5 in the form of a toner concentration deviation signal indicating how much the current concentration deviates from the reference level. On the other hand, in accordance with a copy size signal from the detector 6, the CPU 5 selects an appropriate one of the toner concentration control tables stored therein as described before. And, then, from the thus selected table, the CPU 5 chooses appropriate control information as to time period and rotation speed and supplies this information to the adjusting circuit 9.

Under the circumstances, as the copying operation has been initiated, the counter 8 starts to count the number of copies made. Upon completion of the first copy, if the toner concentration of the developer within the tank T is maintained at the reference level, the toner concentration deviation signal is "0,0,0,0" so that the copying operation proceeds without toner replenishing operation. On the other hand, if the toner concentration of the developer inside of the tank T has been found to deviate from the reference level, then, upon depression of the copy button for the next copying operation, the toner replenishing roller R is driven to rotate for a selected time period at a selected rotational speed based on the information currently set in the adjusting circuit 9, as described previously. Thus, a desired amount of toner is supplied to the tank T from the container C within a desired time period.

For example, if the toner concentration of the developer inside of the tank T deviates far from the reference level, whereby the toner concentration deviation signal indicates "1,1,1,1", then the rotation speed of motor M or roller R is set at 120 rpm and the time period for toner replenishment operation is set at 2 seconds, so that a relatively large amount of toner flows from the container C into the tank T for a short period of time. Accordingly, the toner concentration of the developer inside of the tank T rapidly increases toward the reference level. In this case, the count of 2 is preset in the counter 8 so that the toner concentration detecting operation is carried out every two copies made. In other words, under the condition, every time when the count of counter 8 reaches "2" as the copying operation is carried out, the counter 8 supplies as its output a sampling signal to the CPU 5 so that the CPU 5 implements the toner concentration detecting operation using the concentration detector 1.

However, since the toner concentration of the developer inside of the tank T has risen to approach the reference level due to the previous toner replenishing operation, e.g., the toner concentration deviation signal indicating "1,0,0,0", the condition of toner replenishing operation is reset, for example, such that the rotational speed of motor M or roller R is 90 rpm and the time period for toner replenishing operation is 1 sec. Thus, the toner replenishing operation now proceeds at a lower rate, and, at the same time, the count of "8" is preset in the counter 8. Then, the count of the counter 8 reaches "8" as the copying operation proceeds, the count is cleared and then "11" is preset in the counter 8 while detecting again the current deviation of toner concentration from the reference level. If the deviation has been found to be very small, such as "0,0,1,1", then the operating condition for motor M or roller R is reset to 60 rpm and 0.5 sec. Under the condition, a relatively small amount of toner is supplied from the container C to the tank T thereby making the toner concentration of the developer inside of the tank T arrive at the intended reference level. If the toner concentration of the developer inside of the tank T arrives at the reference level, "11" is preset in the counter 8, so that every time when the counter 8 counts up to "11", the CPU 5 carries out the toner concentration detecting operation.

If a copy has been made for an original of high image density, the toner within the developer inside of the tank T has been consumed significantly thereby causing to lower the toner concentration abruptly. Under the condition, when the toner concentration detecting operation is carried out, there is obtained a toner concentration deviation signal indicating a large deviation from the reference level. Even in this case, in accordance with the principle of the present invention, a relatively high rotational speed of the motor M or roller R and a relatively long time period of toner replenishing operation are set by the CPU 5 so that a relatively large flow of toner is established from the container C to the tank T. Accordingly, the toner concentration of the developer inside of the tank T can be rapidly recovered to the intended reference level, which, in turn, allows to maintain the developed image constant in density.

Now, if the size of copy sheets to be used has been changed, for example, from A4 to B4, then this fact is detected by the size detector 6 which supplies an appropriate size signal to the CPU 5. Thus, the CPU selects an appropriate one of the plurality of toner concentration control tables stored therein for use.

As described above, in accordance with the preferred embodiment of the present invention, it is so structured that the toner concentration detecting operation is carried out for every number of copies which is selected in inverse proportion to the degree of deviation of the detected toner concentration from the reference level, so that the unnecessary data processing is precluded as much as possible thereby lowering the burden of the control system. Besides, it is so structured that the amount of toner to be supplied in a single toner replenishing operation is varyingly set in proportion to the degree of deviation of the detected toner concentration from the reference level, so that the toner concentration of the developer within the tank T can be restored to the reference level as quickly as possible. Moreover, the flow rate of toner to be replenished is optimally set depending on the amount of toner to be replenished, so that there is created no overshoot in the replenishing operation, which has an advantage of stabilizing the developing operation.

In the system shown illustrated in FIG. 1, the detector 1 is provided for directly detecting the toner concentration of the developer. Alternatively, the present invention is also applicable to a system in which the toner concentration of developer is detected indirectly, for example, by forming a developed reference pattern on the peripheral surface of the drum D and measuring the optical density of the thus formed reference pattern using a sensor comprised of an L.E.D. and a light receiving element.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A method for controlling the toner concentration of a developer including toner and carrier, comprising the steps of:

comparing a current toner concentration of said developer with a predetermined reference level for determining a degree of deviation of toner concentration from said reference level;

setting a timing of a next toner concentration detecting operation depending on said degree of deviation; and replenishing toner to said developer in accordance with a result of said comparison while carrying out said toner concentration detecting operation at said timing thus set.

2. The method of claim 1, wherein said step of setting additionally sets a toner replenishing condition and said step of replenishing replenishes toner at said toner replenishing condition thus set by said step of setting.

3. The method of claim 2, further comprising the step of selecting one of a plurality of tables, each containing a plurality of toner replenishing conditions, according to a size of a copy sheet to be used for development prior to the step of comparing.

4. The method of claim 2 wherein said toner replenishing condition includes a flow rate of said toner to be replenished and a time period for carrying out said toner replenishing operation.

5. The method of claim 4, wherein said timing of toner concentration detecting operation is set such that the toner detecting operation is to be carried out for every selected number of copies developed.

6. A system for controlling the toner concentration of a developer comprised of toner and carrier for use in developing an electrostatic latent image, comprising:

first storing means for storing therein a quantity of said developer for use in developing said latent image;

second storing means for storing therein a quantity of said toner to be supplied to said first storing means;

regulating means interposed between said first and second storing means for regulating the flow of said toner from said second storing means to said first storing means;

detecting means for detecting a current toner concentration of said developer; and means for setting a timing of a next toner concentration detecting operation by said detecting means in accordance with a degree of deviation of a current toner concentration level detected by said detecting means from a predetermined reference level.

7. The system of claim 6, further comprising:

control means operatively coupled between said regulating means and said detecting means for controlling the toner concentration of said developer such that said control means varyingly sets an operating condition of said regulating means to supply a desired amount of toner from said second storing means to said first storing means in accordance with a degree of deviation of a current toner concentration level detected by said detecting means from a predetermined reference level.

8. The system of claim 6 wherein said operating condition set by said control means includes a flow rate and time period for supplying said toner from said second storing means to said first storing means.

9. The system of claim 7 wherein said control means includes a central processing unit which has a memory containing therein a plurality of toner concentration control tables, each having the information of said flow rate, time period and frequency, wherein said CPU selects one of said tables for use depending on the size of copy sheet to be used for development.

10. The system of claim 9 wherein said regulating means includes a replenishing roller interposed between said first and second storing means, a motor for rotating said roller and a driver circuit for controlling the operation of said motor.

11. The system of claim 10 wherein said flow rate of said toner from said second storing means to said first storing means is determined by the rotational speed of said roller.

* * * * *